US008601743B2

(12) United States Patent
Bai

(10) Patent No.: US 8,601,743 B2
(45) Date of Patent: Dec. 10, 2013

(54) SIDE HUNG AND BOTTOM HUNG DOUBLE-OPENING WINDOW, STRUCTURE, AND CONTROL DEVICE THEREOF

(75) Inventor: Baokun Bai, Guangdong Province (CN)

(73) Assignee: Guangdong Kin Long Hardware Products Co., Ltd., Guangdong Province (CN)

( * ) Notice: Subject to any disclaimer, the term of this patent is extended or adjusted under 35 U.S.C. 154(b) by 316 days.

(21) Appl. No.: 12/952,546

(22) Filed: Nov. 23, 2010

(65) Prior Publication Data

US 2011/0126465 A1 Jun. 2, 2011

(30) Foreign Application Priority Data

Dec. 2, 2009 (CN) ..... 2009 1 0188648

(51) Int. Cl.
*E05D 15/52* (2006.01)

(52) U.S. Cl.
USPC ..... 49/192; 49/163; 49/366

(58) Field of Classification Search
USPC ..... 49/192, 193, 149, 163, 366, 367, 400, 49/401
See application file for complete search history.

(56) References Cited

U.S. PATENT DOCUMENTS

| | | | | |
|---|---|---|---|---|
| 1,728,040 | A * | 9/1929 | Carl | 49/164 |
| 4,624,075 | A * | 11/1986 | Vigreux | 49/192 |
| 4,928,428 | A * | 5/1990 | Gebhardt et al. | 49/192 |
| 6,772,480 | B2 * | 8/2004 | Prevot et al. | 16/257 |

* cited by examiner

*Primary Examiner* — Katherine Mitchell
*Assistant Examiner* — Catherine A Kelly
(74) *Attorney, Agent, or Firm* — Rosenberg, Klein & Lee

(57) ABSTRACT

A side hung and bottom hung double-opening window includes a first casement, a handle, a first top-link hinge and a first down hinge, a first angle-turning device, a second casement, a second top-link hinge and a second down hinge, a second angle-turning device, a latch block, a sliding piece, and a latch piece. The window can realize side hung and bottom hung double-opening, thus providing the user with other options to open it. Furthermore, the window has a smaller size and a higher reliability.

16 Claims, 11 Drawing Sheets

SIDE HUNG AND BOTTOM HUNG DOUBLE-OPENING WINDOW, STRUCTURE, AND CONTROL DEVICE THEREOF

BACKGROUND OF THE INVENTION

1. Field of the Invention

The present disclosure relates generally to windows, and more particularly, to a side hung and bottom hung double-opening window, structure, and control device thereof.

2. Description of the Related Art

Typically, in modern architecture, side-hinged windows, bottom-hung sashes, swivel frame windows, swinging windows and sash windows are used. A disadvantage of traditional windows is that in an open state, the side-hinged windows protrude deeply into the space of the room, whereas bottom-hung casements provide only limited possibility for allowing air to pass, and do not allow for a direct opening with the outside environment.

Therefore, there is room for improvement within the art.

SUMMARY OF THE INVENTION

A preferred embodiment of the invention eliminates the above deficiencies, and provides a window making the opening of the whole window surface possible, and at the same time, producing intermediate window-openings of any size, and in which the closed state can be produced by casements (also called sashes) in one plane.

In a preferred embodiment, a side hung and bottom hung double-opening window includes a first casement; a handle located on the first casement; a first top-link hinge and a first down hinge located on the first casement connecting to the handle, configured to realize side hung or bottom hung open; a first angle-turning device located on the first casement, configured to turn a vertical-direction movement into a horizontal-direction movement; a second casement; a second top-link hinge and a second down hinge located on the second casement connecting to the handle, configured to realize side hung or bottom hung open; a second angle-turning device located on the second casement, configured to turn a vertical-direction movement into a horizontal-direction movement; a latch block fixed to a fixing member located on a vertical side of one of the first casement and the second casement, the latch block defining a guiding groove, a sidewall of the guiding groove corresponding to a side hung direction defining a through notch; a sliding piece movably connected to a vertical-moving member located on a vertical side of one of the first casement and the second casement, the sliding piece being slidably received in the guiding groove of the latch block, the sliding piece defining a latching groove having an opening facing the side hung direction; and a latch piece movably connected to a vertical-moving member located on a vertical side of the other one of the first casement and the second casement, the latch piece being capable of being received in or disengaged from the latching groove through the opening.

These and other features of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
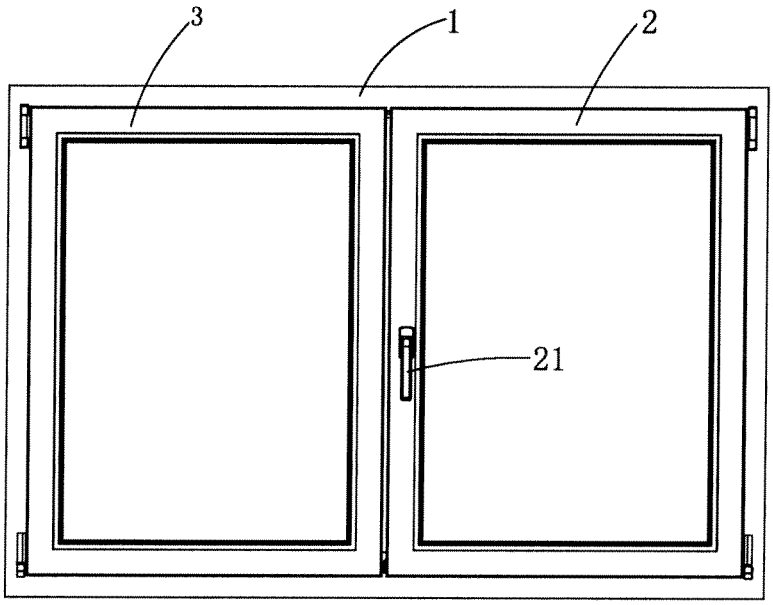
FIG. 1 is a schematic, front view of an embodiment of a side hung and bottom hung double-opening window, showing in a locking state.
Figure 2:
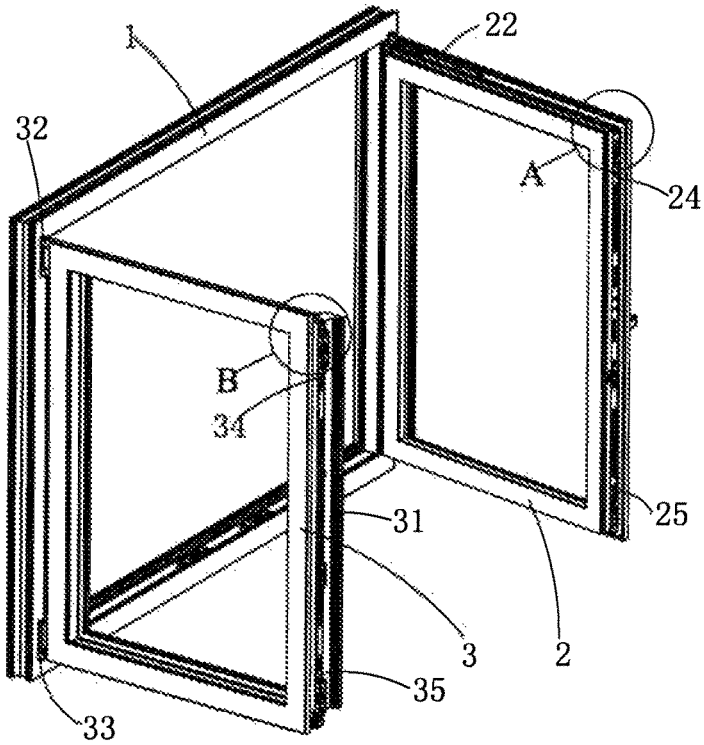
FIG. 2 is a schematic, isometric view of the side hung and bottom hung double-opening window of FIG. 1, showing in a side hung open state.
Figure 3:
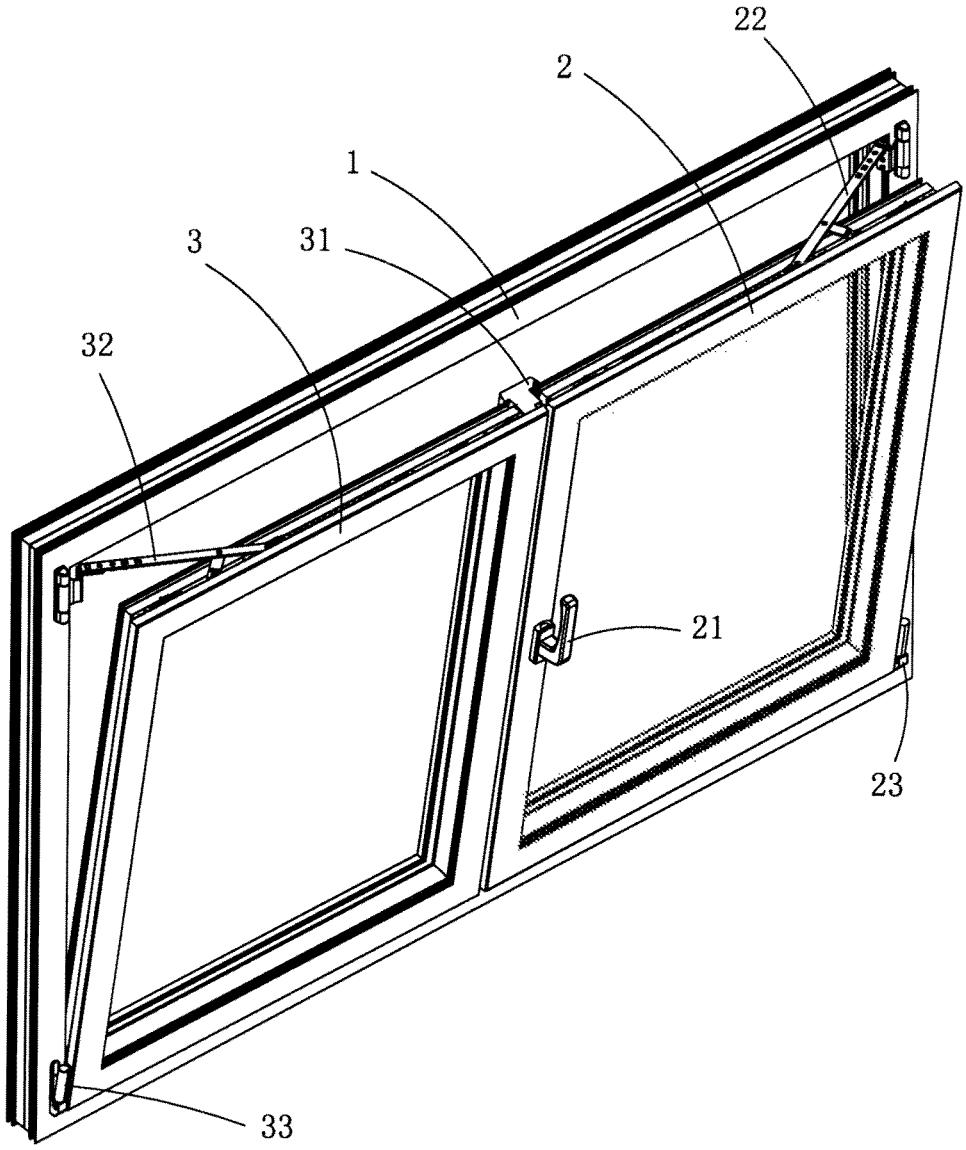
FIG. 3 is a schematic, isometric view of the side hung and bottom hung double-opening window of FIG. 1, showing in an bottom hung open state.

Referring to FIGS. 1 to 3, an embodiment of the side hung and bottom hung double-opening window includes a window frame 1, a first casement 2, and a second casement 3. The window has features that the first casement 2 and the second casement 3 can be side hung opened as shown in FIG. 2, and they can also be fixed together to be bottom hung opened as shown in FIG. 3.

In order to seal the window, the second casement 3 includes a fake-astragal 31 located on a vertical side of the second casement 3 to cover a gap between the first casement 2 and the second casement 3.

Figure 4:
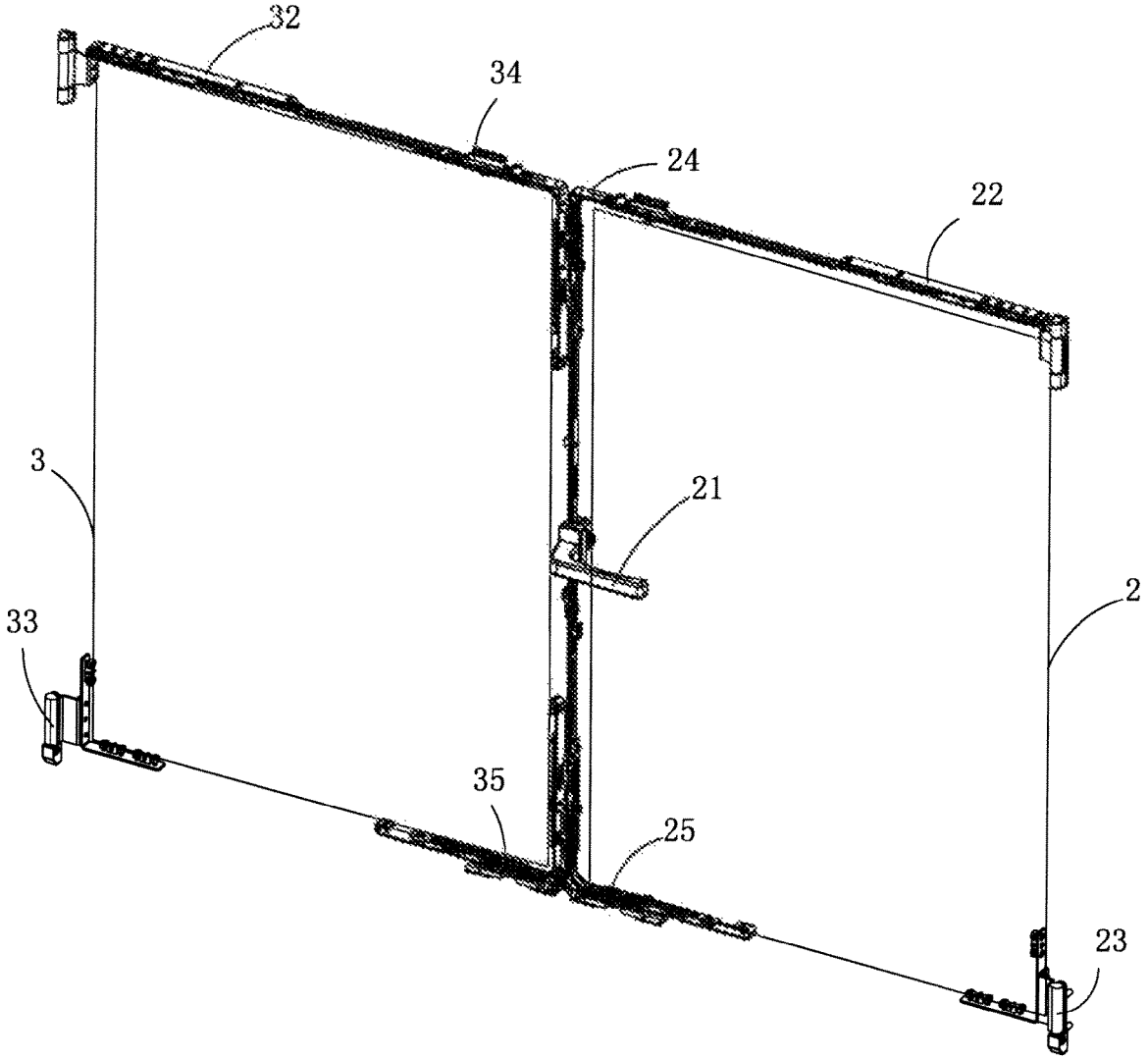
FIG. 4 is a schematic, isometric view of the inside structure of the side hung and bottom hung double-opening window of FIG. 1.

Referring to FIG. 4, the window includes a handle 21, a first top-link hinge 22, a first down hinge 23, a first top angle-turning device 24, and a first down angle-turning device 25 located on the first casement 2 to realize the open or the close of the window.

Figure 5:
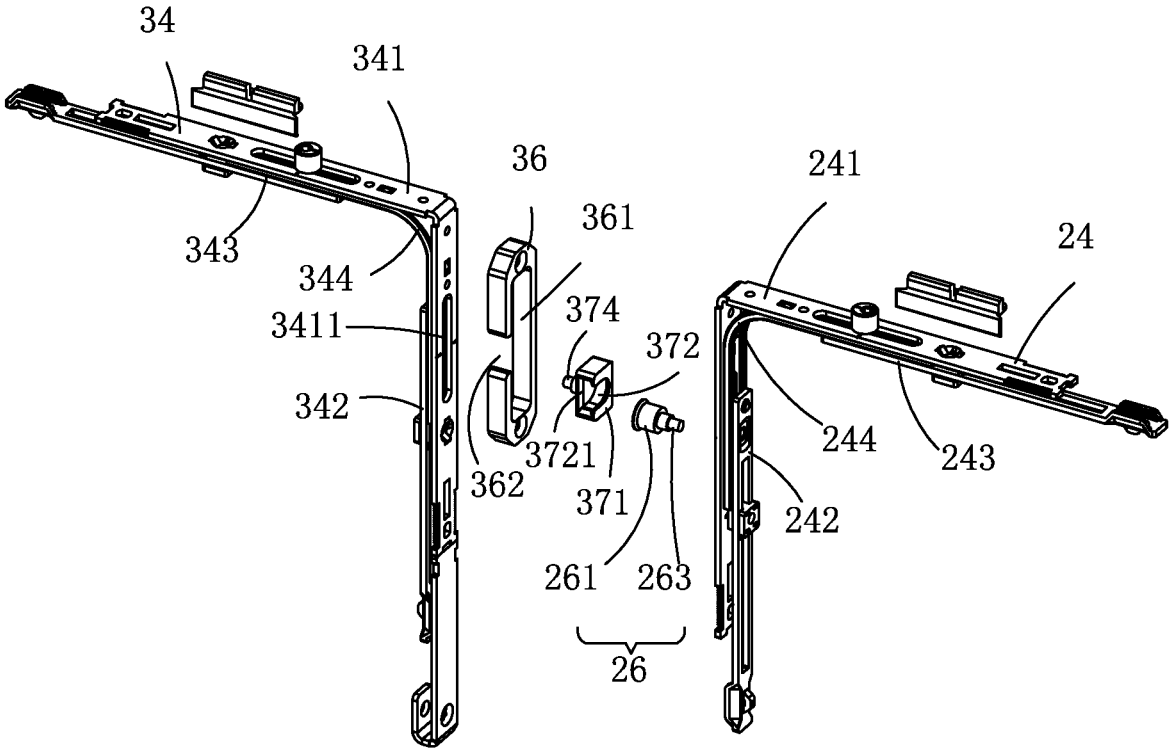
FIG. 5 is a partial, disassemble view of the first top angle-turning device and the second top angle-turning device of FIG. 4.
Figure 6:
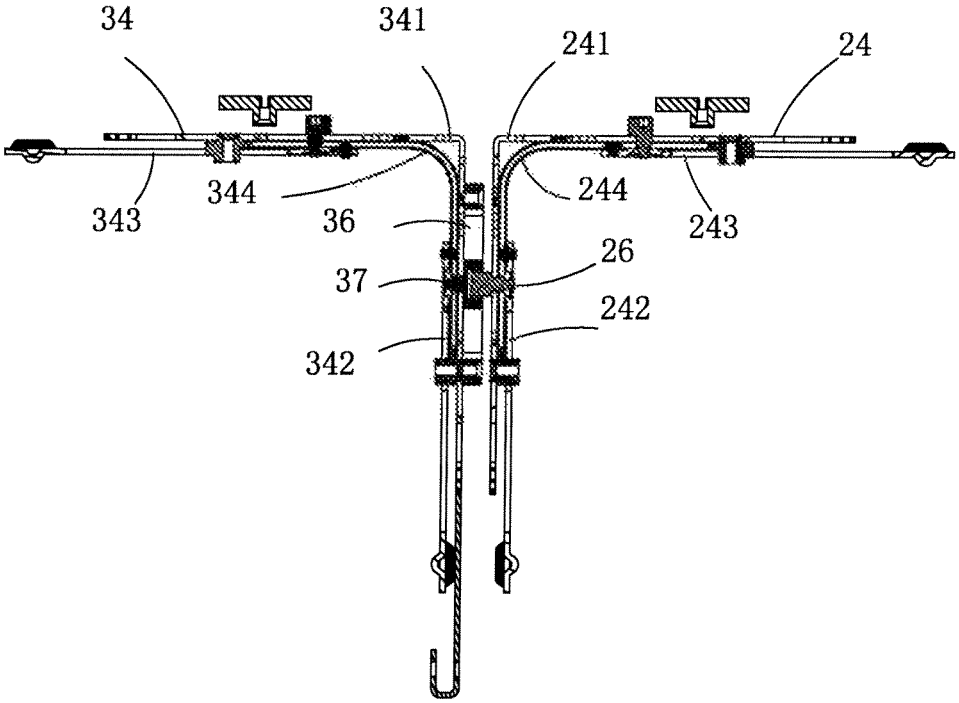
FIG. 6 is a cross-sectional view of a first top angle-turning device and a second top angle-turning device of FIG. 5.

The first top-link hinge 22 is configured to realize lock or side hung or bottom hung open, it may be the one described in Chinese Application Ser. No. CN200420103460.9, CN200520057940.0, CN200720146073.7, both filed by the same applicant and incorporated herein by reference. The first down hinge 23 is configured to realize lock or side hung or bottom hung open, it may be the one describe in Chinese Application Ser. No. CN200420103461.3, filed by the same applicant and incorporated herein by reference. The first top angle-turning device 24 and the first down angle-turning device 25 is configured to turn a vertical-direction movement of handle 21 into a horizontal-direction movement of the first top-link hinge 22, it may be the one described in Chinese Application Ser. No. CN200420103456.2, CN200620136553.0, CN200820213862.2, CN200820235507.5, both filed by the same applicant and incorporated herein by reference. Referring to FIG. 5 and FIG. 6, the first top angle-turning device 24 includes a base 241, shaped as "L", a vertical linkage 242 slidably mounted on a vertical side of the base 241, a horizontal linkage 243 slidably mounted on a horizontal side of the base 241, and a spring plate 244 interconnecting the vertical linkage 242 and the horizontal linkage 243. The first down angle-turning device 25 has approximately the same structure as the first top angle-turning device 24.

Referring to FIG. 4 again, the window further includes a second top-link hinge 32, a second down hinge 33, a second top angle-turning device 34, and a second down angle-turning device 35 located on the second casement 3 to realize the open or the close of the window.

The second top-link hinge 32 is configured to realize lock or side hung or bottom hung open, it may be the one described in Chinese Application Ser. No. CN200420103460.9, CN200520057940.0, CN200720146073.7, both filed by the same applicant and incorporated herein by reference. The second down hinge 33 is configured to realize lock or side hung or bottom hung open, it may be the one describe in Chinese Application Ser. No. CN200420103461.3, filed by the same applicant and incorporated herein by reference. The second top angle-turning device 34 and the second down angle-turning device 35 is configured to turn a vertical-direction movement of components on the first casement 2 into a horizontal-direction movement of the second top-link hinge 32, it may be the one described in Chinese Application Ser. No. CN200420103456.2, CN200620136553.0, CN200820213862.2, CN200820235507.5, both filed by the same applicant and incorporated herein by reference.

Referring to FIG. 5 and FIG. 6, the second top angle-turning device 34 includes a base 341, shaped as "L", a vertical linkage 342 slidably mounted on a vertical side of the base 341, a horizontal linkage 343 slidably mounted on a horizontal side of the base 341, and a spring plate 344 interconnecting the vertical linkage 342 and the horizontal linkage 343. The second down angle-turning device 35 has approximately the same structure as the second top angle-turning device 34.

Figure 2A:
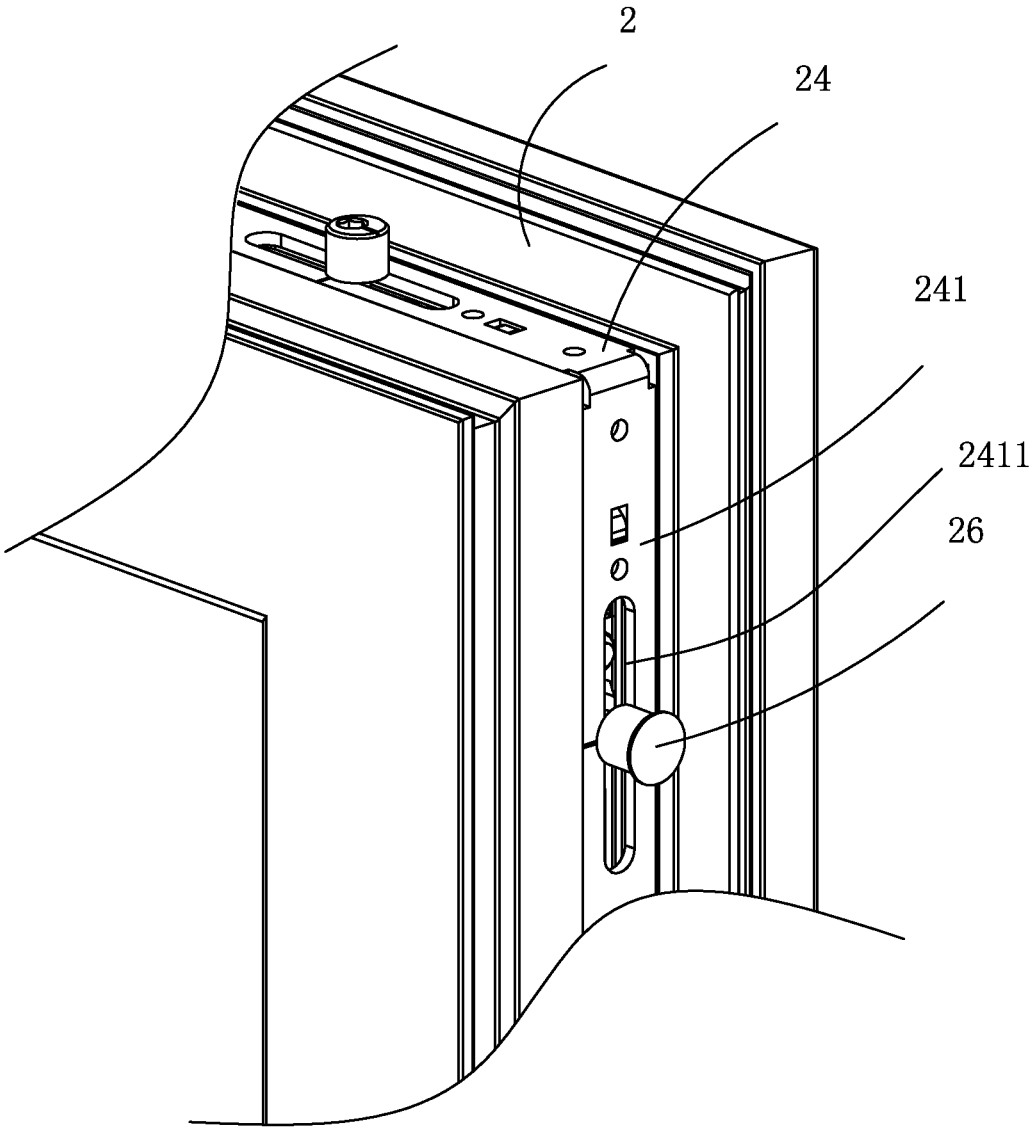
FIG. 2*a* is an enlarged view of a circular part A in FIG. 2.
Figure 7:
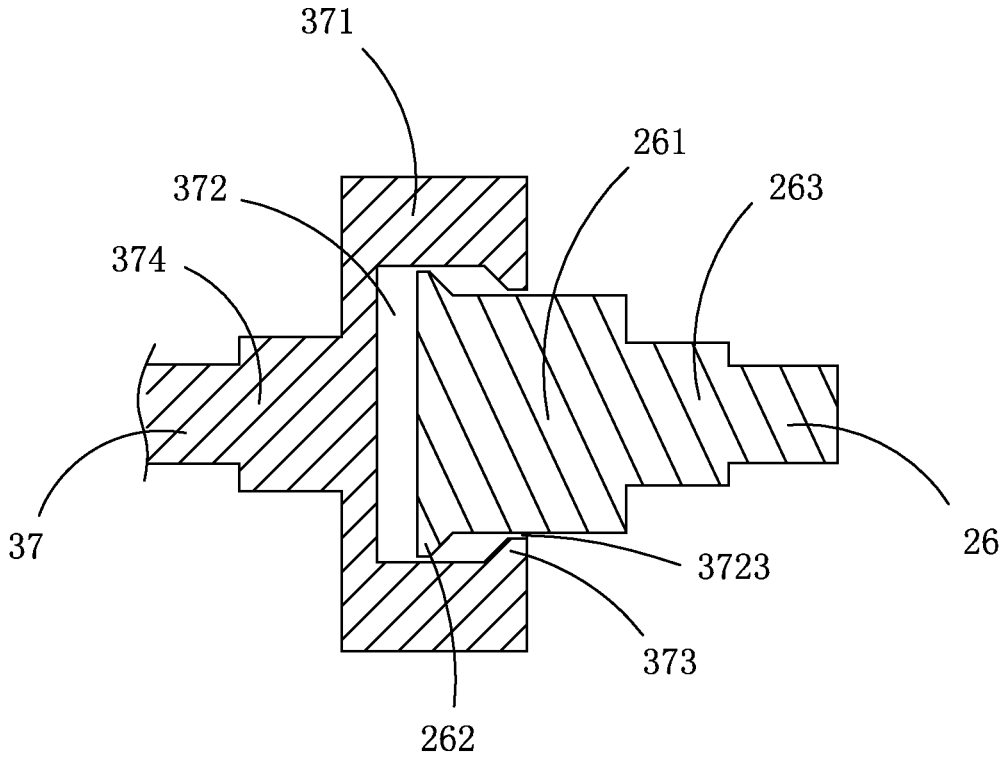
FIG. 7 is an enlarged cross-sectional view of the latch block and the latch piece of FIG. 6.

Referring to FIG. 2A, FIG. 2B, FIG. 5, FIG. 6, and FIG. 7, the side hung and bottom hung double-opening feature are realized by the cooperation of latch piece 26, latch block 36, and the sliding piece 37, which compose a control device of the window. Referring to FIG. 2A, FIG. 5, and FIG. 7, the latch piece 26 includes a latch body 261, which is substantially cylindrical, a flange 262 extending from one end of the latch body 261 having a greater diameter than that of the latch body 261, and a connecting portion 263 extending from the other end of the latch body 261 having a less diameter than that of the latch body 261. Referring also to FIG. 2A and FIG. 6, the base 241 of the first top angle-turning device 24 defines a sliding groove 2411, the connecting portion 263 extends through the sliding groove 2411 and is fixed to the vertical linkage 242. The connecting portion 263 is slidably received in the sliding groove 2411 along with the movement of the vertical linkage 242.

Figure 2B:
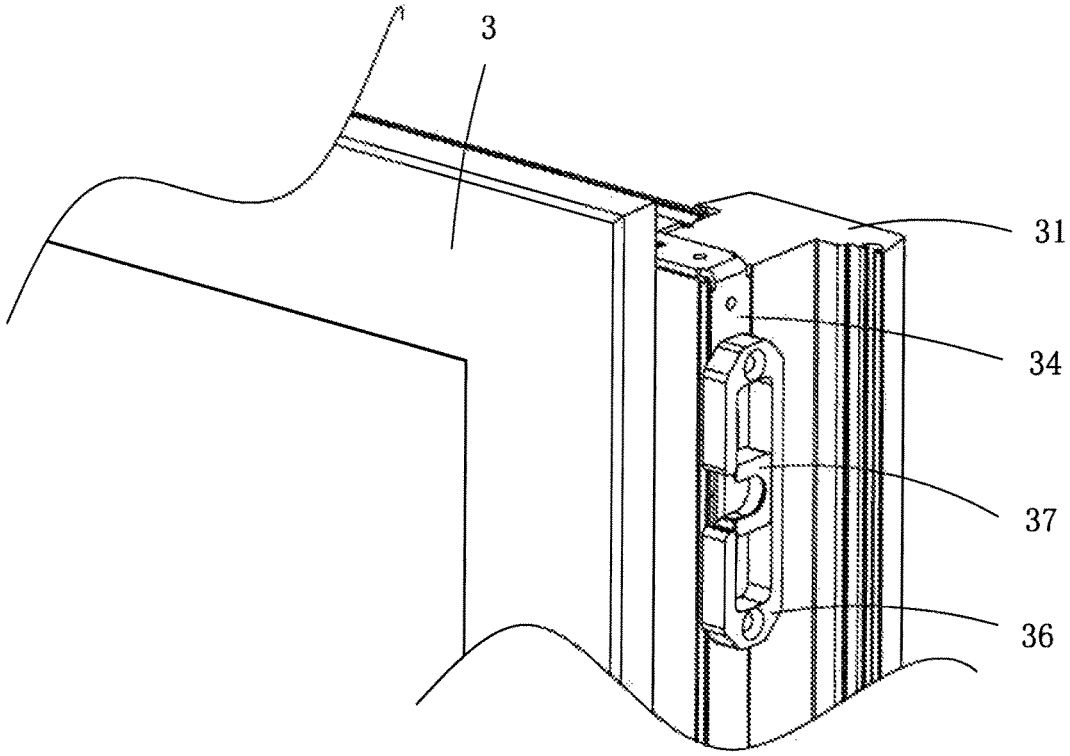
FIG. 2*b* is an enlarged view of a circular part B in FIG. 2.

Referring to FIG. 2B, FIG. 5, and FIG. 7, the sliding piece 37 includes a substantially rectangular main body 371 and a connecting portion 374 extending from a side of the sliding piece 37 having a less thickness. The connecting portion 374 extends through the guiding groove 361, a sliding groove 3411 defined on the base 341 of the second top angle-turning device 34, and then is fixed to the vertical linkage 342, such that the main body 371 is slidably received in the guiding groove 361 along with the movement of the vertical linkage 342. The main body 371 defines a latching groove 372 on a side thereof having an opening 3721 facing the side hung direction. The latch body 261 of the latch piece 26 can be received in the latching groove 372. The main body 371 further defines a hole 3723 communicating with the latching groove 372 to be extended through by the latch body 261. The main body 371 includes a retaining rib 373 located adjacent to the hole 3723 to resist the flange portion 262 of the latch body 261, such that the latch piece 26 is capable of being received in or disengaged from the latching groove 372 through the opening 3721 and is prevented from disengaging from the latching groove 372 through the hole 3723.

During the bottom hung opening, the vertical linkage 242 of the first top angle-turning device 24 is driven to moves along a vertical direction by moving the handle 21 to a bottom hung state. The vertical linkage 242 then drives the latch piece 26 and the sliding piece 37 to slide in the guiding groove 361 of the latch block 36. At that moment, the opening 3721 is not aligned with the through notch 362, and the first casement 2 and the second casement 3 are fixed together in the same plane to rotate along a horizontal axis, thus realizing bottom hung open.

During the side opening, the vertical linkage 242 of the first top angle-turning device 24 is driven to moves along a vertical direction by moving the handle 21 to aside open state. The vertical linkage 242 then drives the latch piece 6 and the sliding piece 37 to slide in the guiding groove 361 of the latch block 36. When the opening 3721 is aligned with the through notch 362, push the first casement 2 horizontally, then the latch piece 26 is disengaged from the sliding piece 37 through the opening 3721 and the through notch 362, such that the first casement 2 and the second casement 3 are separated and rotate along a vertical axis, and side open is realized. During the lock, firstly, place the handle 21 in the side open state, and make sure the opening 3721 is aligned with the through notch 362. Then the first casement 2 and the second casement 3 rotate reversely, such that the latch piece 26 is received in the latching groove 372 of the sliding piece 37 through the opening 3721 and the through notch 362. After that, the vertical linkage 242 of the first top angle-turning device 24 is driven to moves along a vertical direction by moving the handle 21 to a bottom hung state.

Figure 8:
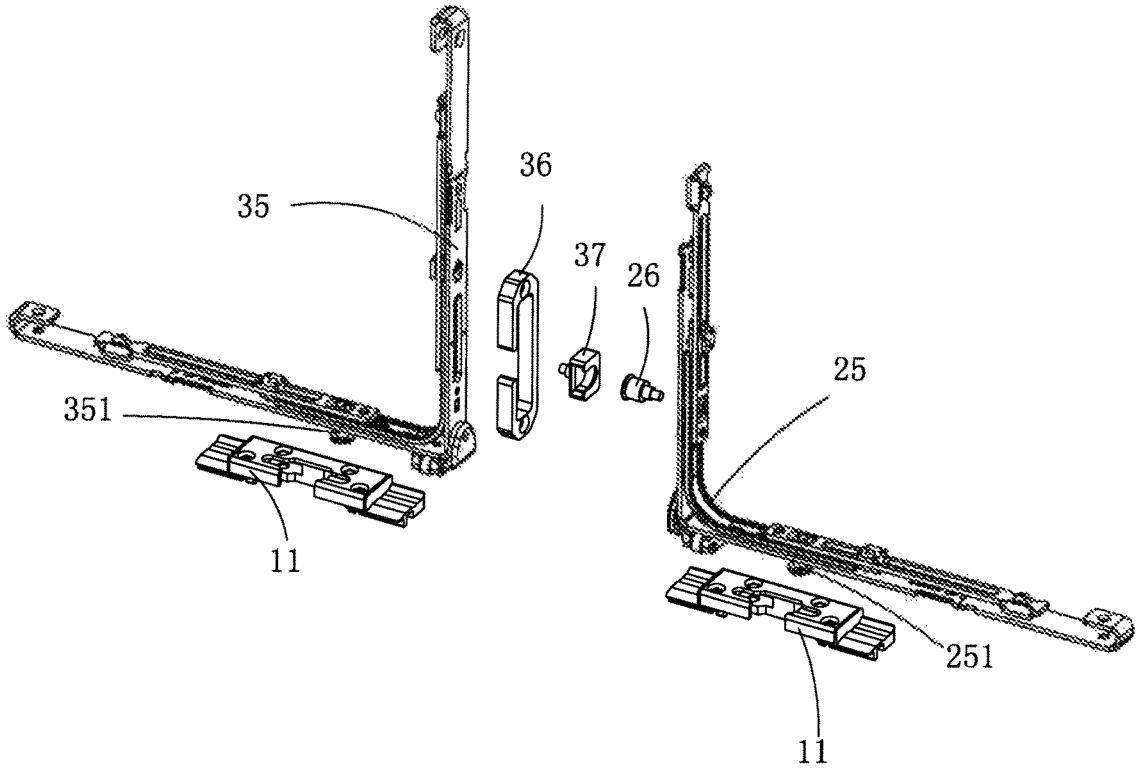
FIG. 8 is a partial, disassemble view of the first down angle-turning device and the second down angle-turning device of FIG. 4.
Figure 9:
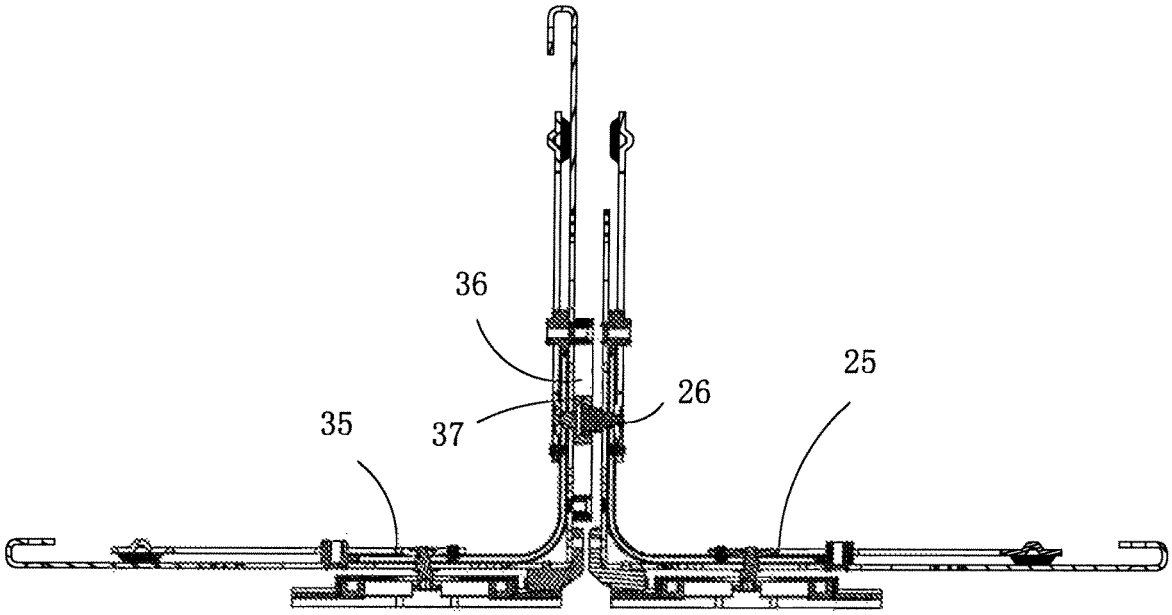
FIG. 9 is a cross-sectional view of a first down angle-turning device and a second down angle-turning device of FIG. 8.

Referring to FIG. 8 and FIG. 9, in alternative embodiment, the latch piece 26, the latch block 36, and the sliding piece 37 is located on the first down angle-turning device 25 and the second down angle-turning device 35. The first down angle-turning device 25 and the second down angle-turning device 35 may include extra latching pieces 251 and 351 located thereon to engage or disengage latch bases 11 located on the first casement 2 and the second casement 3.

For the window described above, it can realize side hung and bottom hung double-opening, thus providing the user with other options to open it. Furthermore, the window has a smaller size and a higher reliability.

It is to be understood that, the number of the latch piece 26, the latch block 36, and the sliding piece 37 may be two or more, and their positions may be switched between the first casement 2 and the second casement 3.

Furthermore, the latch piece 26, the latch block 36, and the sliding piece 37 may not necessarily be located on the angle-turning devices described above, as long as the latch piece 26 is movably connected to a vertical-moving member located on a vertical side of the other one of the first casement 2 and the second casement 3, the latch block 36 is fixed to a fixing member located on a vertical side of one of the first casement 2 and the second casement 3, and the sliding piece 37 is movably connected to a vertical-moving member located on a vertical side of one of the first casement 2 and the second casement 3.

Although the invention has been described in language specific to structural features and/or methodological acts, it is to be understood that the invention defined in the appended claims is not necessarily limited to the specific features or acts described. Rather, the specific features and acts are disclosed as sample forms of implementing the claimed invention.

What is claimed is:

1. A side hung and bottom hung double-opening window, comprising:

a frame;

a first casement;

a first top-link hinge and a first down hinge cooperatively coupling the first casement to the frame for selective side hung or bottom hung operation thereon;

a first angle-turning device located on the first casement, configured to guide a vertical-direction movement of a first vertical linkage and a horizontal-direction movement of a first horizontal linkage along the first casement;

a second casement;

a second top-link hinge and a second down hinge cooperatively coupling the second casement to the frame for selective side hung or bottom hung operation thereon;

a second angle-turning device located on the second casement, configured to guide a vertical-direction movement of a second vertical linkage and a horizontal-direction movement of a second horizontal linkage along the second casement;

a handle located on one of the first and second casements;

a latch block fixed on a vertical side of the first casement, the latch block defining a guiding groove, a sidewall of the guiding groove defining a through notch;

a sliding piece movably connected to the first vertical linkage of the first casement through the latch block to be slidably received in the guiding groove of the latch block, the sliding piece defining a latching groove; and a latch piece movably connected to the second vertical linkage of the second casement, the latch piece releasably engaging the latching groove of the sliding piece to slidably displace therewith in the guiding groove of the latch block, the latch piece being detachable from the sliding piece when the sliding piece latching groove aligns with the through notch of the latch block.

2. The side hung and bottom hung double-opening window according to claim 1, wherein the latch piece comprises a latch body and a flange portion extending from an end of the latch body, the sliding piece further defines a hole communicating with the latching groove to receive the latch body, the sliding piece further comprises a retaining rib located adjacent to the hole resisting the flange portion to prevent the latch piece from disengaging the latching groove from the hole.

3. The side hung and bottom hung double-opening window according to claim 2, wherein the second angle-turning device comprises a L-shaped base, the second angle-turning device further comprises the second vertical linkage slidably mounted on a vertical side of the L-shaped base, the second horizontal linkage slidably mounted on a horizontal side of the L-shaped base, and a spring plate interconnecting the second vertical linkage and the second horizontal linkage.

4. The side hung and bottom hung double-opening window according to claim 3, wherein the base of one of the second angle-turning device defines a sliding groove, the latch piece further comprises a connecting portion positioned on the other end of the latch body extending through the sliding groove and is fixed to the second vertical linkage, the connecting portion is slidably received in the sliding groove.

5. The side hung and bottom hung double-opening window according to claim 3, wherein the first angle-turning device comprises a L-shaped base, the first vertical linkage slidably mounted on a vertical side of the L-shaped base, the first horizontal linkage slidably mounted on a horizontal side of the L-shaped base, and a spring plate interconnecting the first vertical linkage and the first horizontal linkage; the sliding piece comprises a main body and a connecting portion extending from a side of the sliding piece, the connecting portion extending through the guiding groove of the latch block and a sliding groove defined on the base of the first angle-turning device located on the first casement, and then is fixed to the first vertical linkage of the first casement.

6. The side hung and bottom hung double-opening window according to claim 1, wherein one of the first casement and the second casement comprises a fake-astragal located on one of the vertical sides thereof to cover a gap between the first casement and the second casement.

7. A structure of a side hung and bottom hung double-opening window, comprising:

a frame;

a first top-link hinge and a first down hinge cooperatively coupling a first casement to the frame for selective side hung or bottom hung operation thereon;

a first angle-turning device located on the first casement, configured to guide a vertical-direction movement of a first vertical linkage and a horizontal-direction movement of a first horizontal linkage along the first casement;

a second top-link hinge and a second down hinge cooperatively coupling a second casement to the frame for selective side hung or bottom hung operation thereon;

a second angle-turning device located on the second casement, configured to guide a vertical-direction movement of a second vertical linkage and a horizontal-direction movement of a second horizontal linkage along the second casement;

a handle located on one of the first and second casements;

a latch block fixed on a vertical side of the first casement, the latch block defining a guiding groove, a sidewall of the guiding groove defining a through notch;

a sliding piece movably connected to the first vertical linkage of the first casement through the latch block to be slidably received in the guiding groove of the latch block, the sliding piece defining a latching groove; and a latch piece movably connected to the second vertical linkage of the second casement, the latch piece releasably engaging the latching groove of the sliding piece to slidably displace therewith in the guiding groove of the latch block, the latch piece being detachable from the sliding piece when the sliding piece latching groove aligns with the through notch of the latch block.

8. The structure of a side hung and bottom hung double-opening window of claim 7, wherein the latch piece comprises a latch body and a flange portion extending from an end of the latch body, the sliding piece further defines a hole communicating with the latching groove to receive the latch body, the sliding piece further comprises a retaining rib located adjacent to the hole resisting the flange portion to prevent the latch piece from disengaging the latching groove from the hole.

9. The structure of a side hung and bottom hung double-opening window of claim 8, wherein the second angle-turning device comprises a L-shaped base, the second angle-turning device further comprises the second vertical linkage slidably mounted on a vertical side of the L-shaped base, the second horizontal linkage slidably mounted on a horizontal side of the L-shaped base, and a spring plate interconnecting the second vertical linkage and the second horizontal linkage.

10. The structure of a side hung and bottom hung double-opening window of claim 9, wherein the base of the second angle-turning device defines a sliding groove, the latch piece further comprises a connecting portion positioned on the other end of the latch body extending through the sliding groove and is fixed to the second vertical linkage, the connecting portion is slidably received in the sliding groove.

11. The structure of a side hung and bottom hung double-opening window of claim 9, wherein the first angle-turning device comprises a L-shaped base, the first vertical linkage slidably mounted on a vertical side of the L-shaped base, the first horizontal linkage slidably mounted on a horizontal side of the L-shaped base, and a spring plate interconnecting the first vertical linkage and the first horizontal linkage; the sliding piece comprises a main body and a connecting portion extending from a side of the sliding piece, the connecting portion extending through the guiding groove of the latch block and a sliding groove defined on the base of the first angle-turning device located on the other one of the first casement, and then is fixed to the first vertical linkage of the first casement.

12. A control device of a side hung and bottom hung double-opening window, comprising:

a latch block fixed on a vertical side of a first casement of the window, the latch block defining a guiding groove, a sidewall of the guiding groove defining a through notch;

a sliding piece movably connected to a first vertical linkage of the first casement through the latch block to be slidably received in the guiding groove of the latch block, the sliding piece defining a latching groove; and a latch piece movably connected to a second vertical linkage of a second casement, the latch piece releasably engaging the latching groove of the sliding piece to slidably displace therewith in the guiding groove of the latch block, the latch piece being detachable from the sliding piece when the sliding piece latching groove aligns with the through notch of the latch block.

13. The control device of a side hung and bottom hung double-opening window of claim 12, wherein the latch piece comprises a latch body and a flange portion extending from an end of the latch body, the sliding piece further defines a hole communicating with the latching groove to receive the latch body, the sliding piece further comprises a retaining rib located adjacent to the hole resisting the flange portion to prevent the latch piece from disengaging the latching groove from the hole.

14. The control device of a side hung and bottom hung double-opening window of claim 13, wherein the second casement includes a second angle-turning device comprising a L-shaped base, a second vertical linkage slidably mounted on a vertical side of the L-shaped base, a second horizontal linkage slidably mounted on a horizontal side of the L-shaped base, and a spring plate interconnecting the second vertical linkage and the second horizontal linkage.

15. The control device of a side hung and bottom hung double-opening window of claim 14, wherein the base of the second angle-turning device defines a sliding groove, the latch piece further comprises a connecting portion positioned on the other end of the latch body extending through the sliding groove and is fixed to the second vertical linkage, the connecting portion is slidably received in the sliding groove.

16. The control device of a side hung and bottom hung double-opening window of claim 14, wherein the first casement includes a first angle-turning device comprising a L-shaped base, a first vertical linkage slidably mounted on a vertical side of the L-shaped base, a first horizontal linkage slidably mounted on a horizontal side of the L-shaped base, and a spring plate interconnecting the first vertical linkage and the first horizontal linkage; the sliding piece comprises a main body and a connecting portion extending from a side of the sliding piece, the connecting portion extending through the guiding groove of the latch block and a sliding groove defined on the base of the first angle-turning device located on the first casement, and then is fixed to the first vertical linkage of the first casement.

* * * * *